US011085320B2

(12) United States Patent
Jeanson et al.

(10) Patent No.: US 11,085,320 B2
(45) Date of Patent: Aug. 10, 2021

(54) VARIABLE VANE MECHANISM OF TURBOCHARGER HAVING PREDETERMINED VANE CLEARANCE

(71) Applicant: Garrett Transportation I Inc., Torrance, CA (US)

(72) Inventors: Arthur Jeanson, Chatel sur Moselle (FR); Francis Abel, La Baffe (FR); Emmanuel Crouvizier, Remiremont (FR)

(73) Assignee: GARRETT TRANSPORTATION I INC, Torrance, CA (US)

( * ) Notice: Subject to any disclaimer, the term of this patent is extended or adjusted under 35 U.S.C. 154(b) by 235 days.

(21) Appl. No.: 16/141,395

(22) Filed: Sep. 25, 2018

(65) Prior Publication Data

US 2020/0095886 A1 Mar. 26, 2020

(51) Int. Cl.
*F01D 17/16* (2006.01)
*F02B 37/22* (2006.01)

(52) U.S. Cl.
CPC ..... *F01D 17/16* (2013.01); *F01D 17/165* (2013.01); *F02B 37/22* (2013.01); *F05D 2220/40* (2013.01); *F05D 2230/232* (2013.01); *F05D 2230/60* (2013.01); *F05D 2240/12* (2013.01)

(58) Field of Classification Search
CPC ..... F01D 17/165; F01D 17/16; F02B 37/22; F02B 37/24
See application file for complete search history.

(56) References Cited

U.S. PATENT DOCUMENTS 4,654,941 A * 4/1987 Burdette ..... F01D 17/165 29/889.22
5,553,866 A 9/1996 Heinzen
(Continued)

FOREIGN PATENT DOCUMENTS

| | | |
|---|---|---|
| CN | 107035427 A | 8/2017 |
| WO | 2008098024 A2 | 8/2008 |
| WO | 2013162899 A1 | 10/2013 |

OTHER PUBLICATIONS

EPO search report and opinion from foreign filing of instant application (Year: 2020).*

*Primary Examiner* — David E Sosnowski
*Assistant Examiner* — Wesley Le Fisher
(74) *Attorney, Agent, or Firm* — Lorenz & Kopf LLP

(57) ABSTRACT

A method of manufacturing a variable vane mechanism includes arranging a vane and a spacer between a first support structure and a tool member of a tool. The method also includes abutting a first inner surface of the first support structure against a first side surface of the vane and a second side surface of the vane against an opposing surface of the tool member, leaving a control surface of the spacer projecting from the first support structure at a predetermined distance. The method further includes fixedly attaching the spacer to the first support structure with the control surface of the spacer projecting from the first support structure at the predetermined distance. The method further includes abutting a second support structure on the control surface of the spacer to define a gap between the first support structure and the second support structure with the vane disposed within the gap.

9 Claims, 12 Drawing Sheets

(56) References Cited

U.S. PATENT DOCUMENTS

| | | | | |
|---|---|---|---|---|
| 7,918,023 | B2 * | 4/2011 | Sausse | F01D 9/04 29/889.2 |
| 8,061,976 | B2 * | 11/2011 | Hall | F04D 29/462 415/160 |
| 8,333,556 | B2 * | 12/2012 | Hettinger | F02M 59/105 415/165 |
| 2006/0140751 | A1 * | 6/2006 | Boening | F01D 17/165 415/160 |
| 2008/0193281 | A1 * | 8/2008 | Sausse | F01D 9/04 415/158 |
| 2010/0008766 | A1 * | 1/2010 | Scholz | F01D 17/165 415/160 |
| 2011/0038742 | A1 * | 2/2011 | Fleig | F01D 25/246 417/406 |
| 2015/0110607 | A1 * | 4/2015 | Iizuka | F04D 27/002 415/151 |
| 2015/0110608 | A1 * | 4/2015 | Vemula | F02B 39/00 415/159 |
| 2015/0118038 | A1 * | 4/2015 | Ward | F04D 29/30 415/208.2 |
| 2015/0125288 | A1 * | 5/2015 | Heddy, III | F01D 17/165 415/209.1 |
| 2016/0090858 | A1 * | 3/2016 | Barthelet | F01D 17/16 417/406 |
| 2017/0082018 | A1 * | 3/2017 | Bayod | F02B 37/24 |

* cited by examiner

VARIABLE VANE MECHANISM OF TURBOCHARGER HAVING PREDETERMINED VANE CLEARANCE

TECHNICAL FIELD

The present disclosure generally relates to a variable vane mechanism for a turbocharger and, more particularly, relates to a variable vane mechanism of a turbocharger having a predetermined vane clearance.

BACKGROUND

Some vehicles include a turbocharger, supercharger and/or other devices for boosting the performance of an internal combustion engine. More specifically, these devices can increase the engine's efficiency and power output by forcing extra air into the combustion chamber of the engine.

In some cases, a turbocharger system may include a variable vane mechanism, which is often referred-to as a cartridge (cartridge structure, cartridge assembly, etc.). The mechanism may be included on a turbine section of the turbocharger system. It may include one or more support structures and a plurality of vanes that move relative to the support structure(s) to selectively change flow parameters in the exhaust gas supply to a turbine wheel. The vanes may be moved, for example, according to the operating speed of the engine.

The vanes may be supported by the support structures via fasteners, etc. There may be some amount of clearance space between the vanes and the support structure(s) to allow relative movement of the vanes. However, excessive clearance space may allow for leakage that degrades the operating efficiency or other performance characteristics of the turbocharger.

Accordingly, it is desirable to provide a variable vane mechanism that provides a predetermined amount of clearance space between the vanes and the support structure. Furthermore, it is desirable to provide improved manufacturing methods for forming such variable vane mechanisms. Other desirable features and characteristics of the present disclosure will become apparent from the subsequent detailed description and the appended claims, taken in conjunction with the accompanying drawings and this background discussion.

BRIEF SUMMARY

In one embodiment, a method of manufacturing a variable vane mechanism is disclosed that includes arranging a vane and a spacer between a first support structure and a tool member of a tool. The method also includes abutting a first inner surface of the first support structure against a first side surface of the vane and a second side surface of the vane against an opposing surface of the tool member, leaving a control surface of the spacer projecting from the first support structure at a predetermined distance. The method further includes fixedly attaching, while abutting the first inner surface against the first side surface and the second side surface against the opposing surface, the spacer to the first support structure with the control surface of the spacer projecting from the first support structure at the predetermined distance. The method further includes abutting, after fixedly attaching the spacer to the first support structure, a second support structure on the control surface of the spacer to define a gap between the first support structure and the second support structure with the vane disposed within the gap.

In addition, a variable vane mechanism for a turbocharger is disclosed. The variable vane mechanism includes a first support structure, a second support structure, and a vane disposed within a gap defined between the first and second support structures. The vane is supported for movement within the gap. The variable vane mechanism also includes a spacer with a first part and a second part. The first part is supported by the first support structure and the second part is supported by the second support structure to maintain a width dimension of the gap and a vane clearance dimension. The width dimension is measured from the first support structure to the second support structure. The vane clearance dimension is measured between the vane and at least one of the first and second support structures. The spacer extends partially through the first support structure.

In an additional embodiment, a method of manufacturing a variable vane mechanism is disclosed. The method includes selecting a thickness of a shim according to a predetermined vane clearance dimension for the variable vane mechanism. The method also includes arranging a vane and a spacer between a first support structure and a tool member of a tool. The tool member includes a base and the selected shim. Moreover, the method includes abutting a first inner surface of the first support structure against a first side surface of the vane, a second side surface of the vane against the shim, and a control surface of the spacer against the base, leaving the control surface of the spacer projecting from the first support structure at a predetermined distance. Furthermore, the method includes fixedly attaching, while abutting the first inner surface against the first side surface and the second side surface against the shim, the spacer to the first support structure with the control surface of the spacer projecting from the first support structure at the predetermined distance. Additionally, the method includes abutting, after fixedly attaching the spacer to the first support structure, a second support structure on the control surface of the spacer to define a gap between the first support structure and the second support structure, the vane disposed within the gap with the predetermined vane clearance dimension.

BRIEF DESCRIPTION OF THE DRAWINGS

The present disclosure will hereinafter be described in conjunction with the following drawing figures, wherein like numerals denote like elements, and wherein.

DETAILED DESCRIPTION

The following detailed description is merely exemplary in nature and is not intended to limit the present disclosure or the application and uses of the present disclosure. Furthermore, there is no intention to be bound by any theory presented in the preceding background or the following detailed description.

Broadly, example embodiments disclosed herein include a turbocharger with a variable vane mechanism (cartridge, cartridge structure, cartridge assembly, etc.). The variable vane mechanism may include certain features that improve the operating performance of the turbocharger. Also, features of the present disclosure may increase manufacturability of the variable vane mechanism. As will be discussed, clearance between the vanes and one or more supporting structures may be selectively and precisely controlled in a repeatable fashion due to one or more features of the present disclosure. Additionally, the predetermined clearance may be relatively small, thereby limiting leakage and increasing operating efficiency as a result.

Figure 1:
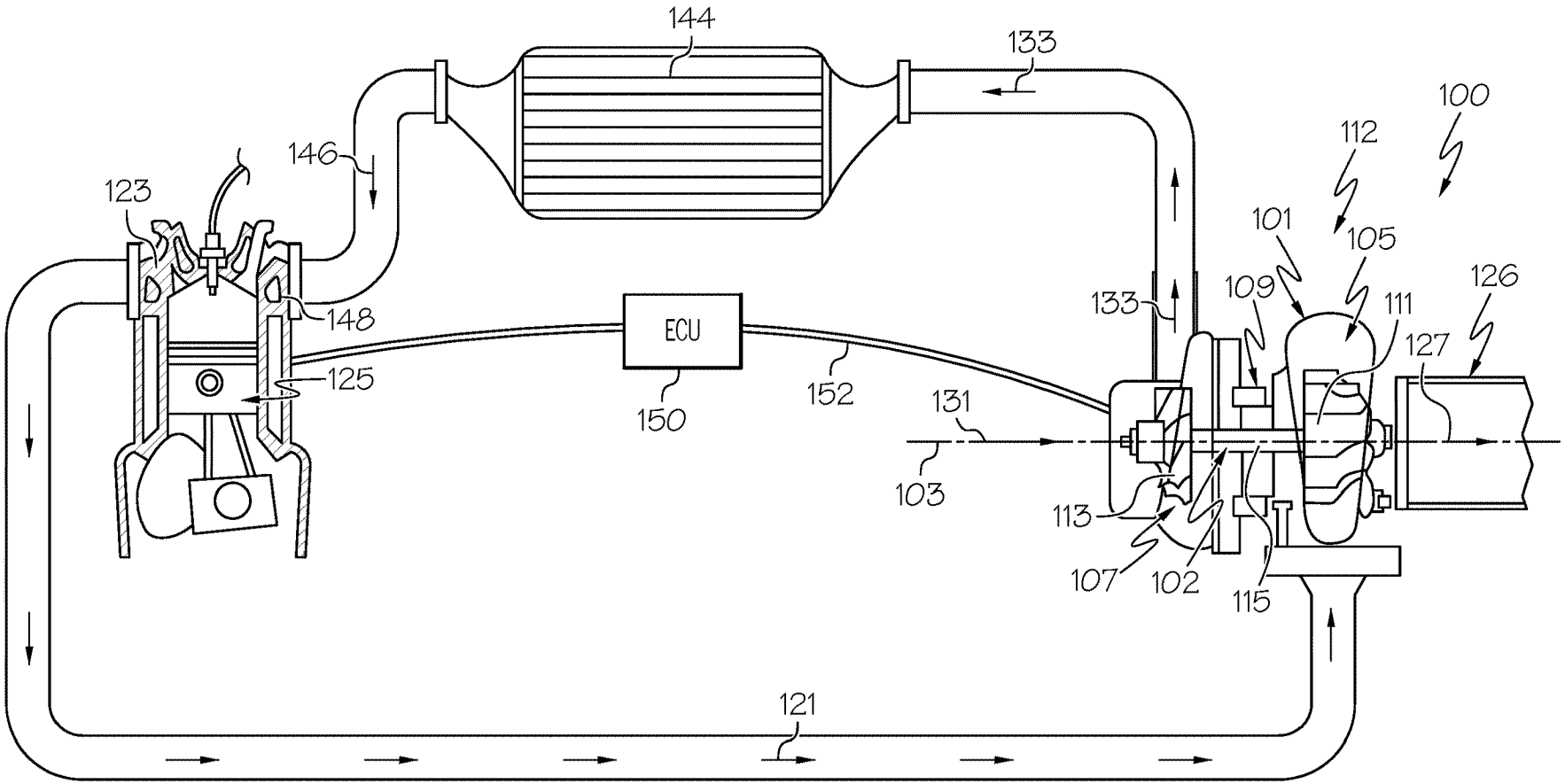
FIG. 1 is a schematic view of a turbocharger system according to example embodiments of the present disclosure.

FIG. 1 is a schematic view of an example turbocharger system 100 that includes a turbocharger 112. The turbocharger 112 generally includes a turbocharger housing 101 and a rotor 102. The rotor 102 is configured to rotate within the turbocharger housing 101 about an axis of rotor rotation 103. The rotor 102 may be supported for rotation about the axis 103 via one or more bearings (not shown). In some embodiments, the rotor 102 may be rotationally supported by thrust bearings and a plurality of journal bearings. Alternatively, other bearings may be included.

As shown in the illustrated embodiment, the turbocharger housing 101 may include a turbine housing 105, a compressor housing 107, and a bearing housing 109. The bearing housing 109 may be disposed between the turbine and compressor housings 105, 107. Also, in some embodiments, the bearing housing 109 may contain the bearings of the rotor 102.

Additionally, the rotor 102 includes a turbine wheel 111, a compressor wheel 113, and a shaft 115. The turbine wheel 111 is located substantially within the turbine housing 105. The compressor wheel 113 is located substantially within the compressor housing 107. The shaft 115 extends along the axis of rotation 103, through the bearing housing 109, to connect the turbine wheel 111 to the compressor wheel 113. Accordingly, the turbine wheel 111 and the compressor wheel 113 rotate together about the axis 103.

The turbine housing 105 and the turbine wheel 111 cooperate to form a turbine (i.e., turbine section, turbine stage) configured to circumferentially receive a high-pressure and high-temperature exhaust gas stream 121 from an engine, e.g., from an exhaust manifold 123 of an internal combustion engine 125. The turbine wheel 111 (and thus the rotor 102) is driven in rotation around the axis 103 by the high-pressure and high-temperature exhaust gas stream 121, which becomes a lower-pressure and lower-temperature exhaust gas stream 127 that is released into a downstream exhaust pipe 126. In other embodiments, the engine 125 may be of another type, such as a diesel fueled engine.

The compressor housing 107 and compressor wheel 113 cooperatively form a compressor section of the turbocharger system 100 (i.e., a compressor stage). The compressor wheel 113, being driven in rotation by the exhaust-gas driven turbine wheel 111, is configured to compress received input air 131 (e.g., ambient air, or already-pressurized air from a previous-stage in a multi-stage compressor) into a pressurized air stream 133 that is ejected circumferentially from the compressor housing 107. The compressor housing 107 may have a shape (e.g., a volute shape or otherwise) configured to direct and pressurize the air blown from the compressor wheel 113. Due to the compression process, the pressurized air stream 133 is characterized by an increased temperature, over that of the input air 131.

The pressurized air stream 133 may be channeled through an air cooler 144 (i.e., intercooler), such as a convectively cooled charge air cooler. The air cooler 144 may be configured to dissipate heat from the pressurized air stream 133, increasing its density. The resulting cooled and pressurized output air stream 146 is channeled into an intake manifold 148 of the internal combustion engine 125, or alternatively, into a subsequent-stage, in-series compressor. The operation of the system 100 may be controlled by an ECU 150 (engine control unit) that connects to the remainder of the system via communication connections 152.

Figure 2:
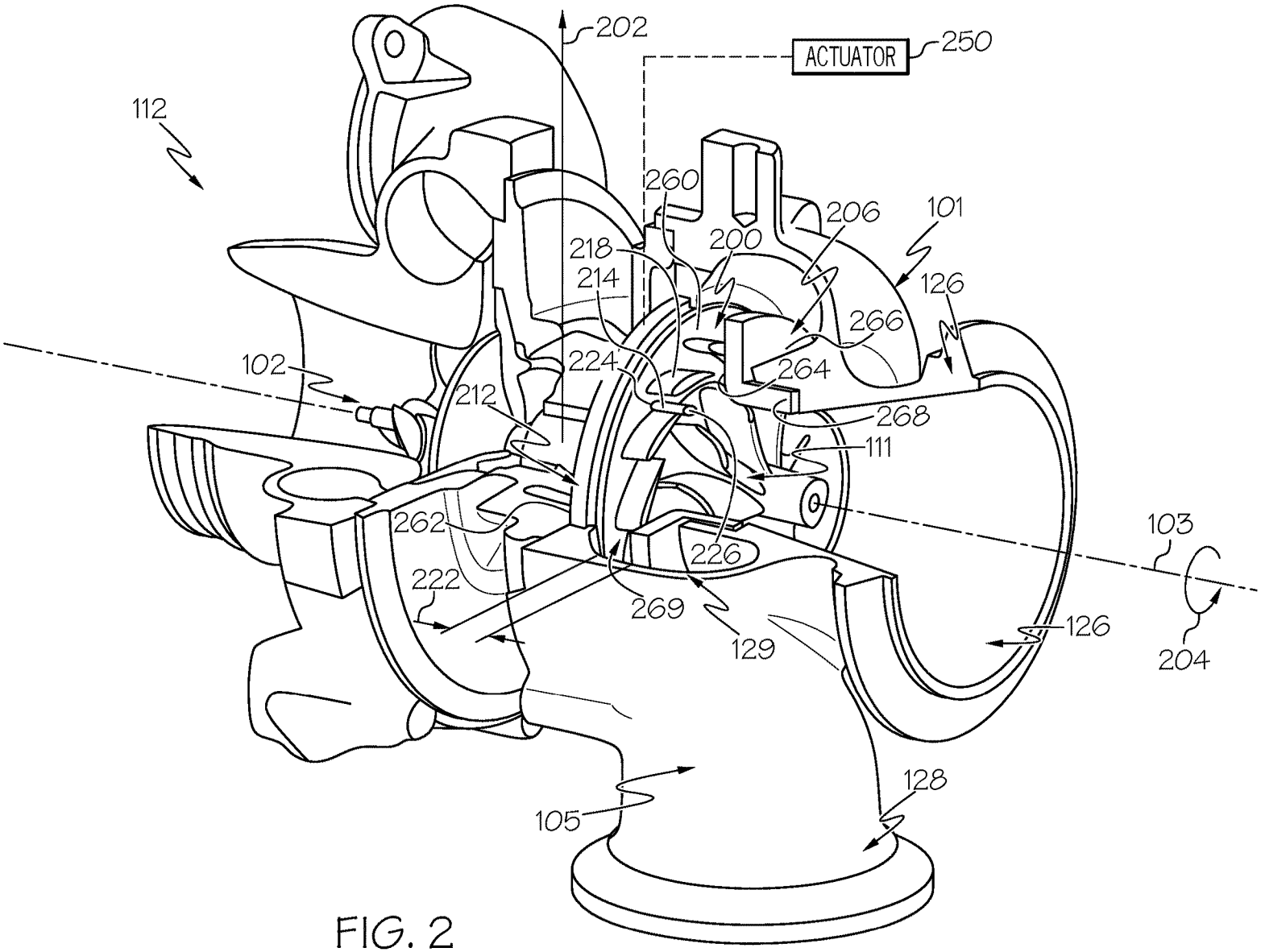
FIG. 2 is a sectioned perspective view of a turbocharger of the turbocharger system of FIG. 1.

Referring now to FIG. 2, additional details of the turbocharger 112 will be discussed according to example embodiments. Portions of the turbocharger housing 101 and other portions are hidden for clarity. Elements of a radial coordinate system are also shown for reference, such as the axis of rotation 103 of the rotor 102, a representative radial axis 202, and an arrow 204 that represents the circumferential direction extending about the axis 103.

As shown, the turbine housing 105 may include an inlet pipe 128 and the downstream exhaust pipe 126. The downstream exhaust pipe 126 may be substantially centered on the axis 103, and the inlet pipe 128 may be disposed substantially normal to the axis 103. Furthermore, the turbine housing 105 may include a volute flow structure 129 that is disposed between the inlet pipe 128 and the exhaust pipe 126. In some embodiments, the inlet pipe 128, the volute flow structure 129, and the downstream exhaust pipe 126 may be integrally attached as a unitary, monolithic part (e.g., as a casting).

The turbine wheel 111 may be supported for rotation and housed within the volute flow structure 129 of the turbine housing 105. Furthermore, a variable vane mechanism 200 (i.e., a cartridge, cartridge assembly, etc.) may be disposed within the volute flow structure 129. The variable vane mechanism 200 and the turbine wheel 111 may be substantially coaxial and centered on the axis 103 with the variable vane mechanism 200 surrounding the outer radial edge of the turbine wheel 111.

During operation, the inlet pipe 128 may receive the exhaust gas stream 121 from the engine 125, and the exhaust gas stream 121 may be redirected to flow about the axis 103 within the volute flow structure 129 and radially inward through the variable vane mechanism 200 to drive the turbine wheel 111. The exhaust gas stream 127 may then exit via the downstream exhaust pipe 126.

Figure 3:
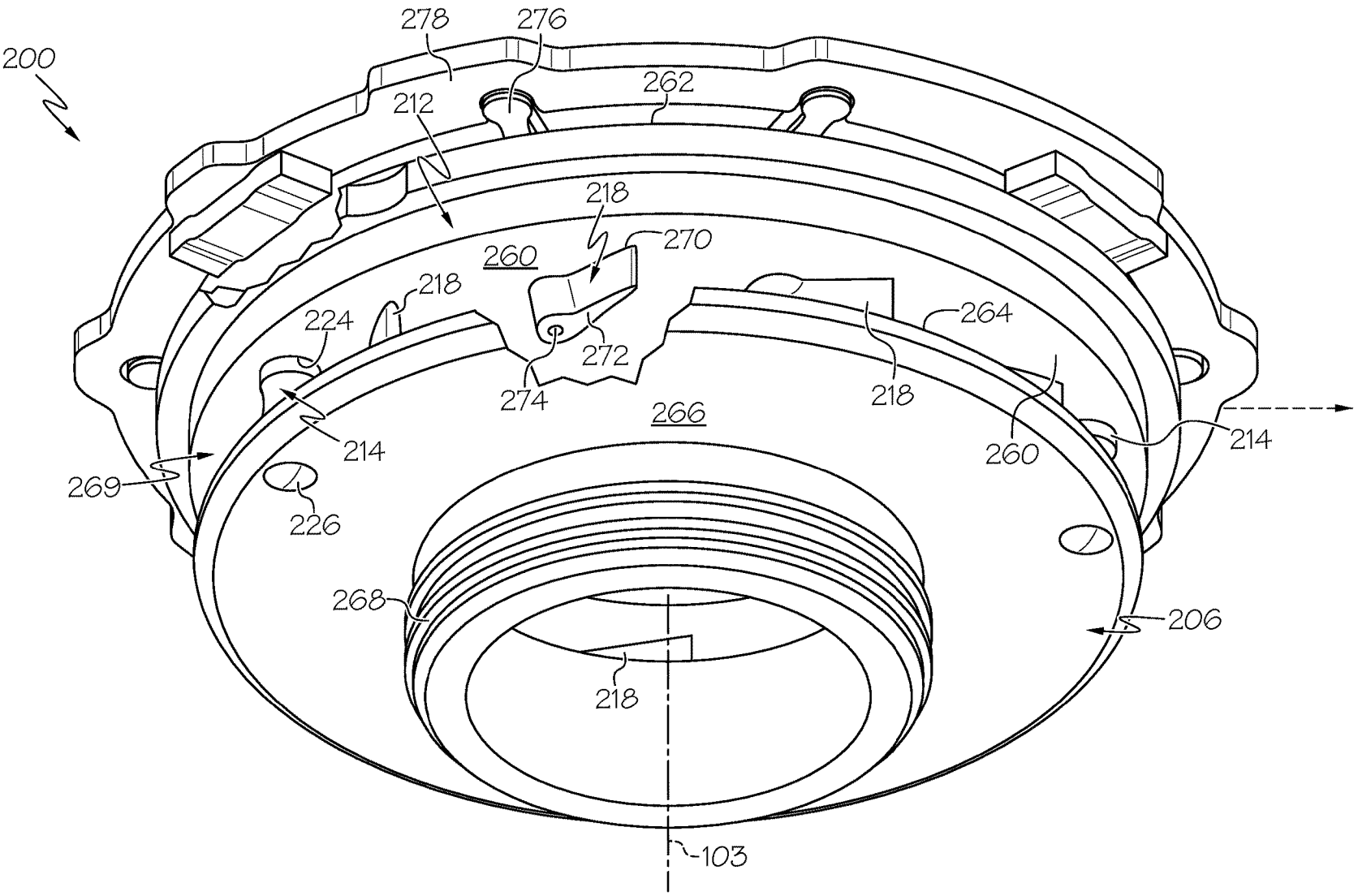
FIG. 3 is a perspective view of a variable vane mechanism of the turbocharger of FIG. 2 according to example embodiments of the present disclosure.

The variable vane mechanism 200 is shown in isolation in FIG. 3 according to an example embodiment of the present disclosure. The variable vane mechanism 200 is also represented schematically in the cross-section of FIG. 4.

Generally, the variable vane mechanism 200 may include first support structure 212 (i.e., a nozzle ring, etc.). The first support structure 212 may be a rigid, strong member that is disc-like and/or annular in shape. The first support structure 212 may include an inner surface 260 and an opposing outer surface 262. The first support structure 212 may be fixed to the turbine housing 105 as represented in FIG. 2. The first support structure 212 may be substantially centered on the axis 103.

The variable vane mechanism 200 may also include a second support structure 206 (i.e., insert, pipe, etc.). The second support structure 206 may be a rigid, strong member that is annular in shape. (A sector of the annular second support structure 206 is hidden in FIG. 2 for clarity.) The second support structure 206 may include an inner surface 264 and an opposing outer surface 266. In some embodiments, the second support structure 206 may include an inner lip 268 that projects from the outer surface 266 and that is fixed to the turbine housing 105. The second support structure 206 may be arranged such that the inner surface 264 faces opposite the inner surface 260 of the first support structure 212. The inner surface 264 of the second support structure 206 may be substantially parallel and spaced apart from the inner surface 260 of the first support structure 212 so as to define a gap 269 therebetween.

Figure 4:
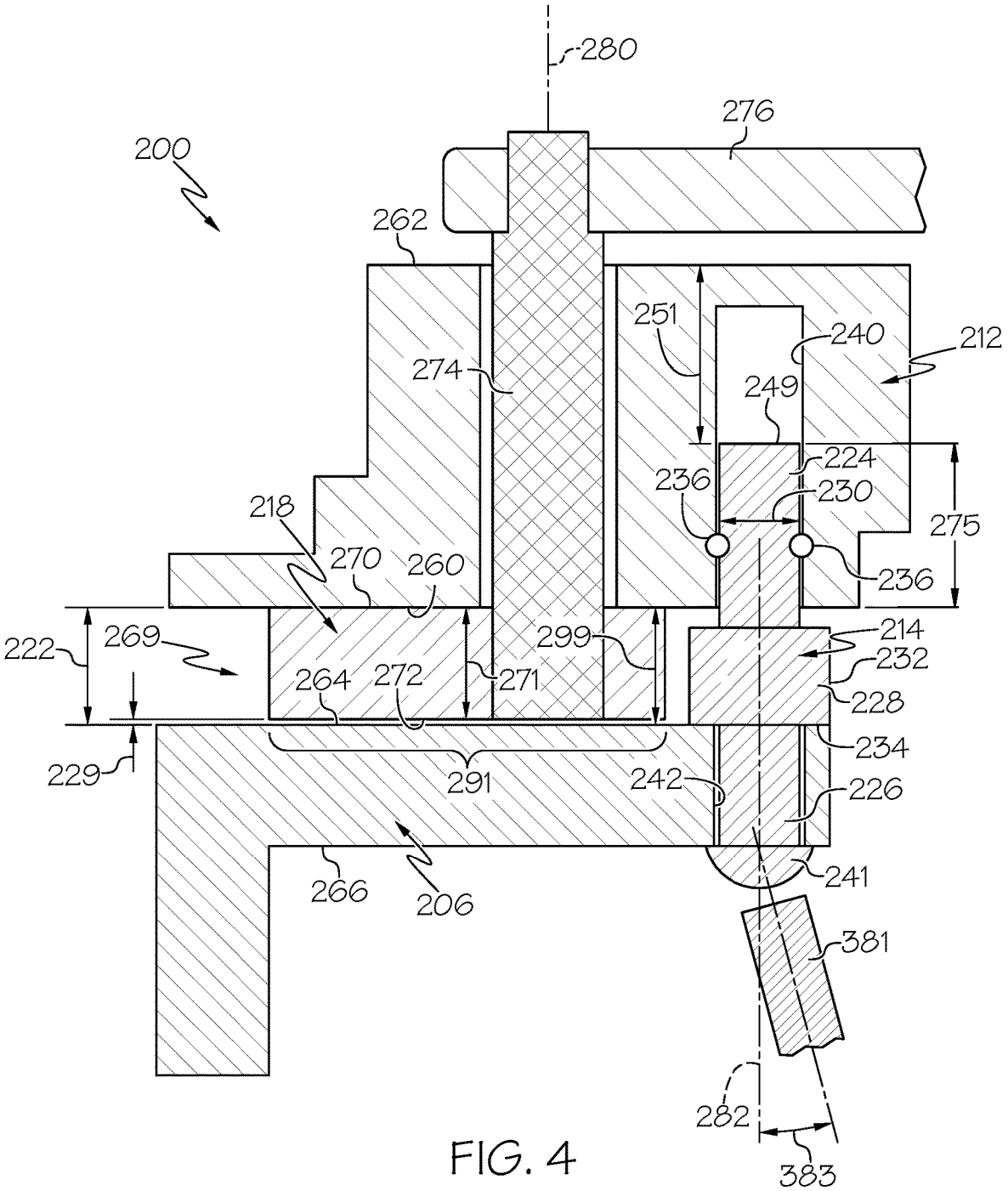
FIG. 4 is a schematic section view of the variable vane mechanism according to example embodiments of the present disclosure.

The variable vane mechanism 200 may further include a plurality of vanes 218. The vanes 218 may be substantially similar to each other. The vanes 218 may be disposed within the gap 269, between the first support structure 212 and the second support structure 206 and spaced apart substantially equally apart circumferentially about the axis 103. Each vane 218 may have an airfoil shape and may include a first side surface 270 and a second side surface 272. The vane 218 may also have a thickness 271 measured from the first side surface 270 to the second side surface 272 (FIG. 4). The first side surface 270 may oppose the inner surface 260 of the first support structure 212. The second side surface 272 may oppose the inner surface 264 of the second support structure 206.

As shown in FIGS. 3 and 4, the vane 218 may fixed to a rod 274 that extends through a bore in the first support structure 212. An opposite end of the rod 274 may be attached to a respective arm 276 that is disposed adjacent the outer surface 262 of the first support structure 212. In other words, the rod 274 may extend entirely through a thickness of the first support structure 212 in the region illustrated in FIG. 4. As shown in FIG. 3, the arm 276 may be pivotally attached to a unison ring 278. The unison ring 278 may be supported for rotational movement about the axis 103 relative to the first support structure 212. This rotation may, in turn, rotate the vane 218 about an axis 280 of the rod 274 between a first position and a second position. The plurality of vanes 218 may be operably attached to the unison ring 278 in this manner. Thus, rotation of the unison ring 278 may move (e.g., rotate) the vanes 218 substantially synchronously within the gap 269 relative to the first and second support structures 212, 206.

The variable vane mechanism 200 may further include an actuator 250 (FIG. 2). The actuator 250 may be configured for driving rotation of the unison ring 278, the arms 220, and the vanes 218 relative to the first and second support structures 212, 206. The actuator 250 may include an electric motor in some embodiments. The actuator 250 may also be in communication with a processor of the ECU 150 (FIG. 1). Accordingly, the ECU 150 may generate and send control commands to the actuator 250 for selectively moving the unison ring 278 and the vanes 218. For example, the processor may receive one or more inputs (e.g., signals corresponding to the current engine speed, exhaust gas characteristics, etc.). The processor may determine a target position of the vanes 218 based on these inputs according to control logic, one or more algorithms, etc. Then, the processor may generate control signals that prompt the actuator 250 to actuate the vanes 218 to the determined position.

During operation, the vanes 218 may be selectively rotated about their respective axes 280 to affect the exhaust gas stream 121. Accordingly, the vanes 218 may move to selectively change the pressure parameters of the gas stream 121 as it is delivered to the turbine wheel 111. The vanes 218 may be moved, for example, according to the speed of the engine 125 to maintain high efficiency of the turbocharger 112.

As shown in FIGS. 2-4, the variable vane mechanism 200 may additionally include one or more spacers 214. In some embodiments, there may be at least three spacers 214. The spacers 214 may be spaced substantially equally about the axis 103. The spacers 214 may be substantially similar to each other. The spacers 214 may be rigid, elongate members having a longitudinal axis 277. The spacers 214 may be configured as rods, posts, substantially cylindrical structures, or the like. As shown in the embodiment of FIG. 4, for example, the spacer 214 may be an elongate, generally, cylindrical structure. The spacer 214 may have a width dimension 230 (i.e., a diameter) that varies along its longitudinal length. In other embodiments, the width dimension 230 may be substantially constant along substantially the entire length of the spacer 214. The spacer 214 may be a unitary, one-piece member that is made out of a strong, rigid material, such as metal. The spacer 214 may include a first part 224, a second part 226, and an intermediate part 228. The first and second parts 224, 226 may be disposed on opposite longitudinal ends of the spacer 214, and the intermediate part 228 may be disposed longitudinally between the first and second parts 224, 226. The intermediate part 228 may include a projection 232 that projects radially outward from the longitudinal axis 277 of the spacer 214. In some embodiments, the projection 232 may be a collar that extends continuously and annularly about the longitudinal axis 277 of the spacer 214. The projection 232 may include a control surface 234 that faces toward the second part 226 of the spacer 214. The control surface 234 may be configured to control spacing between the first support structure 212 and the second support structure 206 as will be discussed.

The spacer 214 may be supported on and/or supported by the first support structure 212 and the second support structure 206 to thereby maintain a width 222 of the gap 269 as substantially constant. The width 222 may be measured between (and normal to) the inner surface 260 of the first support structure 212 and the inner surface 264 of the second support structure 206. The spacer 214 may, at least, contact and abut the first and/or second support structure 212, 206 so as to be "supported by" the same. In some embodiments, the spacer 214 may be fixedly attached to the first and/or second support structure 212, 206 so as to be "supported by" the same. Moreover, in some embodiments, the spacer 214 may be received in the first and/or second support structure 212, 206 to be "supported by" the same.

As shown in the embodiment illustrated in FIG. 4, for example, the first part 224 may be received within a first spacer aperture 240 of the first support structure 212 to be supported by the first support structure 212. The first part 224 extends to a predetermined depth 275 of the aperture 240. The depth 275 may be measured from the rim of the aperture 240 (at the first inner surface 260) to the terminal end 249 of the first part 224 of the spacer 214.

Also, the first part 224 may be fixedly attached to the first support structure 212 to be supported thereby. Such attachments 236 are illustrated schematically in FIG. 4. For example, the attachment 236 may be a weldment produced by a welding process (e.g., a laser welding process). In additional embodiments, the attachment 236 may be a friction-fit attachment (i.e., one that is held together primarily due to the force of friction) between the outer surface of the first part 224 and the inner surface of the first spacer aperture 240. In some embodiments, the first part 224 may be knurled to increase the strength of the attachment 236. The attachment 236 may be disposed along the axis 277 at any point where the first part 224 is fixed to the first spacer aperture 240. The attachment 236 is shown mid-way between a rim of the first spacer aperture 240 and a terminal end 249 of the spacer 214; however, the attachment 236 may be considered to be located anywhere along the depth 275 (including at the rim of the aperture 240).

Additionally, in some embodiments, the second part 226 may be fixedly attached to the second support structure 206 to be supported thereby. The second part 226 may be riveted to the second support structure 206 in some embodiments. More specifically, as shown, the second part 226 may be received in a second spacer aperture 242, and the second part 226 may include an enlarged rivet head 241. Accordingly, the second part 226 may be retained within the second spacer aperture 242 with the underside of the rivet head 241 abutting the outer surface 266 and the control surface 234 abutting the inner surface 264. When assembled, the first part 224 of the spacer 214 may be received within the first support structure 212, the second part 226 may be received within the second support structure 206, and the intermediate part 228 may extend across the gap 269 of the variable vane mechanism 200.

The spacers 214 may be configured to define the width 222 of the gap 269 of the variable vane mechanism 200. Specifically, the width 222 may be controlled according to a distance 299 between the first inner surface 260 and the abutment of the control surface 234 and the second inner surface 264. In other words, the distance 299 may be the amount that the control surface 234 projects from the first inner surface 260. The spacers 214 may be configured to maintain (at a substantially constant dimension) the width 222 of the gap 269. For example, the spacer 214 may limit movement of the first support structure 212 toward the second support structure 206 along the axis 103 (e.g., due to a compressive load on the vane mechanism 200, due to thermal expansion, etc.).

Furthermore, by maintaining the size of the gap 269, the spacer 214 may maintain a vane clearance dimension 229 for the vanes 218 as shown in FIG. 4. The vane clearance dimension 229 may be equal to the thickness 271 of the vane 218 subtracted from the width 222 of the gap 269. In FIG. 4, the vane 218 is shown disposed directly adjacent the inner surface 260 of the first support structure 212 such that the vane clearance dimension 229 is evident only between the second side surface 272 of the vane 218 and the inner surface 264 of the second support structure 206. In other words, the vane clearance dimension 229 is shown as an amount of space between the second side surface 272 and an area 291 of the inner surface 264 directly opposite the second side surface 272. However, it will be appreciated that the vane 218 may be spaced apart from the first support structure 212 such that at least part of the clearance dimension 229 may be defined between the first side surface 270 of the vane 218 and the inner surface 260 of the first support structure 212.

In the embodiment of FIG. 4, the inner surface 260 of the first support structure 212 is substantially planar and the inner surface 264 of the second support structure 206 is substantially planar as well. Also, the control surface 234 is substantially co-planar with the inner surface 264. Accordingly, the distance 299 that the control surface 234 projects from the first inner surface 260 controls the width 222 of the gap 269. Therefore, the distance 299 also controls the clearance dimension 229 of the variable vane mechanism 200. Similarly, the depth 275 of penetration of the spacer 214 within the first support structure 212 may control the width 222 and the vane clearance dimension 229. As will be discussed, various manufacturing methods are disclosed herein that may be used to selectively control the depth 275 of the spacer 214 within the spacer aperture 240 and/or the distance 299 between the attachment 236 and the control surface 234 of the spacer 214. As such the vane clearance dimension 229 may be selectively controlled during assembly of the variable vane mechanism 200.

It will be appreciated that the variable vane mechanism 200 may be constructed different from the illustrated embodiments without departing from the scope of the present disclosure. The spacial relationships between the spacer 214 and the support structures 212, 206 may be different as a result. Likewise, the spacial relationship between the spacer 214 and the vane 218 may be different from those illustrated. For example, the control surface 234 and the inner surface 264 of the second support structure 206 may lie in different planes without departing from the scope of the present disclosure. In these cases, manufacturing methods of the present disclosure may be adapted accordingly to provide a predetermined depth 275 and/or distance 299 dimensions.

It is noted that the spacer 214 is partially received within the first support structure 212. In other words, the first part 224 extends part-way into the first spacer aperture 240 of the first support structure 212. As such, a terminal end 249 of the first part 224 is spaced apart at a distance 251 from the outer surface 262 of the first support structure 212. This feature provides various advantages. For example, this feature may make the variable vane mechanism 200 more compact. Also, as will be discussed, this feature may increase manufacturability, manufacturing efficiency, etc. of the variable vane mechanism 200 and/or the turbocharger 112.

In contrast to the first part 224, the second part 226 of the spacer 214 may extend entirely through the second support structure 206. The second support structure 206 may be retained on one side between the collar-like projection 232 and the rivet head 241. Also, a terminal end 282 of the second part 226 defined on the rivet head 241 may protrude from the outer surface 266 of the second support structure 206. As will be discussed, this attachment of the second support structure 206 may provide manufacturing efficiencies.

Methods of manufacturing the variable vane mechanism 200 will now be discussed with reference to FIGS. 5-8. It will be appreciated that this method and/or various features of this method may be employed for manufacture of the embodiment of FIGS. 2-4 and/or to other embodiments of the variable vane mechanism 200 as well. In some embodiments, manufacturing techniques of the present disclosure may improve the operating performance of the turbocharger. These manufacturing methods may increase manufacturing efficiency, accuracy, repeatability, and more. As will be discussed, the vane clearance 229 may be selectively and precisely controlled in a repeatable fashion due to manufacturing methods of the present disclosure. Additionally, the vane clearance 229 may be relatively small, thereby limiting leakage and increasing operating efficiency as a result.

Figure 5:
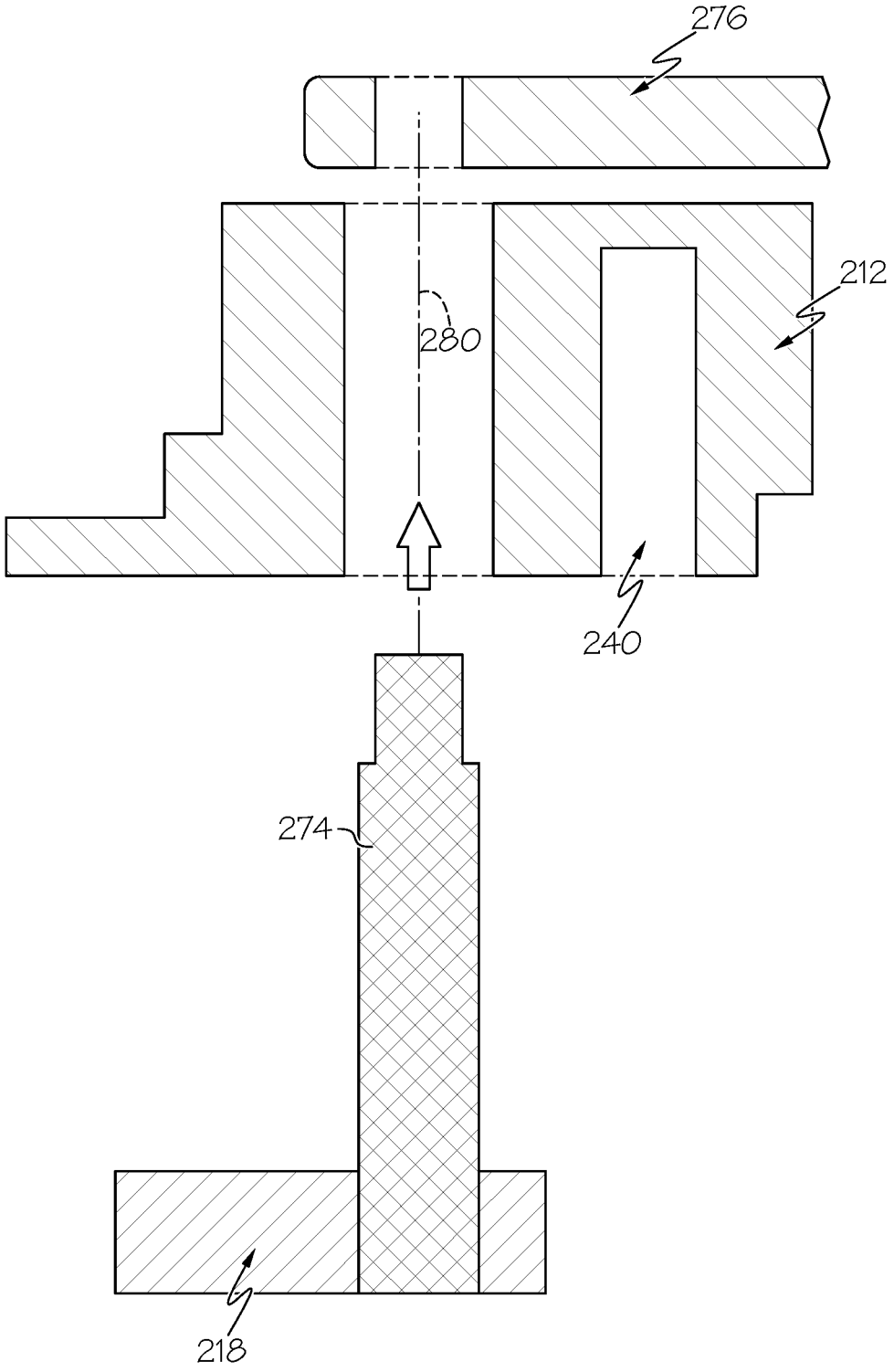
FIGS. 5-8 are schematic section views illustrating a method of manufacturing the variable vane mechanism of FIG. 4 according to example embodiments of the present disclosure.
Figure 6:
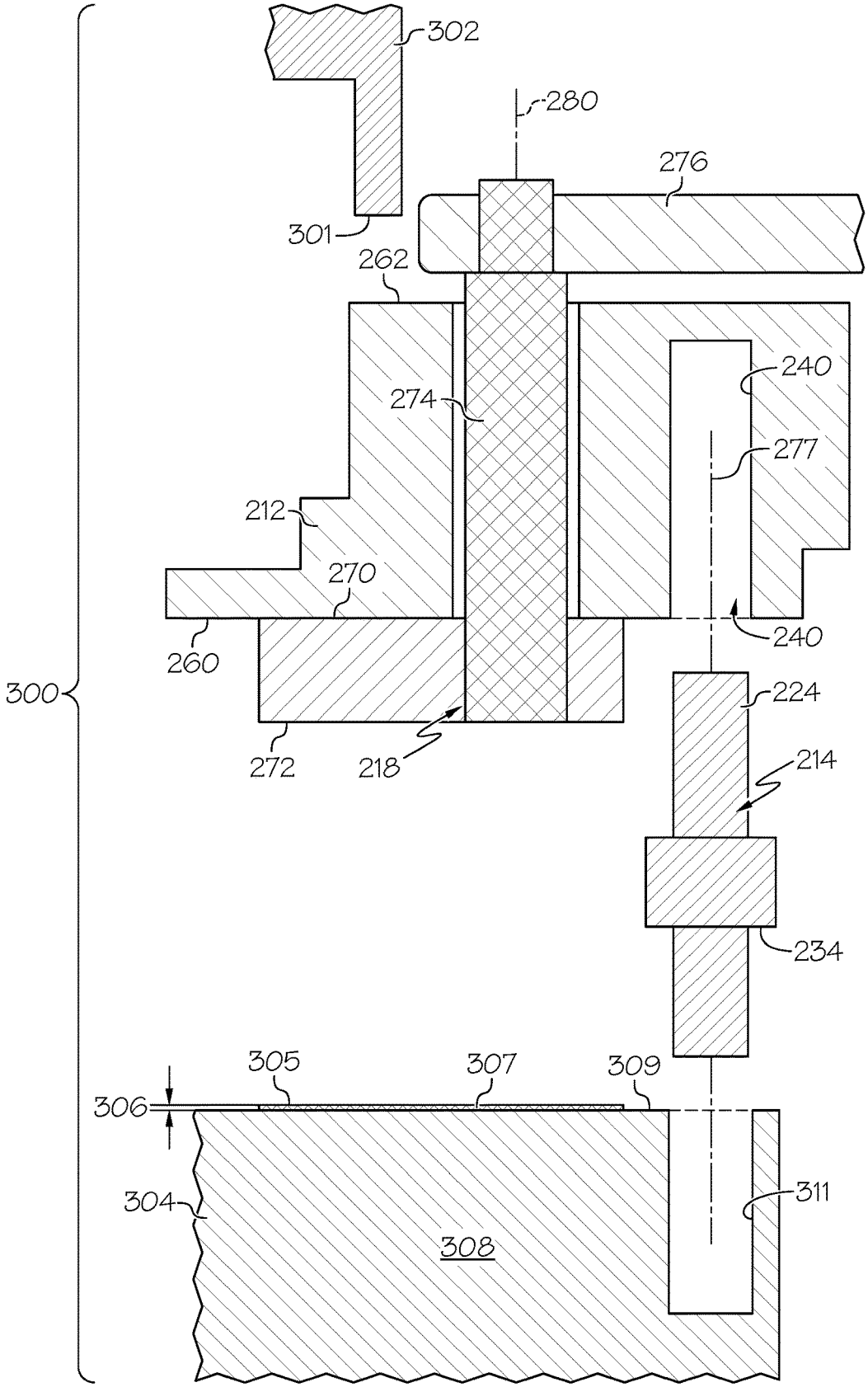

The manufacturing method may begin as represented in FIG. 5. As shown, the vane 218 may be attached to the rod 274, and the rod 274 may be inserted through the first support structure 212. In some embodiments, the arm 276 may be attached to the rod 274 on the end opposite from the vane 218. As shown in FIG. 6, the spacer 214 may be inserted in the spacer aperture 240. The plurality of vanes 218 and spacers 214 may be similarly arranged with the first support structure 212.

These components may be provided within a tool 300 used for assembly. In some embodiments, the tool 300 may be a press or other related mechanism. The tool 300 may include a first tool member 302 (e.g., a first die) and a second tool member 304 (e.g., a second die). The first tool member 302 may include a first contact area 301. The second tool member 304 may include a second contact area 305 and a third contact area 309. The second contact area 305 may be defined on a shim 307. The shim 307 may be an annular member, such as a washer (i.e., a gauge washer). The shim 307 may have a relatively small thickness 306 that is substantially constant. In some embodiments, the shim 307 may be supported by (removably attached to) a planar surface of a base 308 of the second tool member 304. The third contact area 309 may be defined on this planar surface of the base 308, proximate a spacer aperture 311 of the base 308.

In some embodiments, the shim 307 may be removably supported by the base 308. Accordingly, in some embodiments, the shim 307 may be used and replaced with another (e.g., another shim 307 having a different thickness 306). In additional embodiments, the shim 307 and the base 308 may be integrally attached so as to be unitary and such that the shim 307 projects from the base 308 at a distance equal to the thickness 306.

Figure 7:
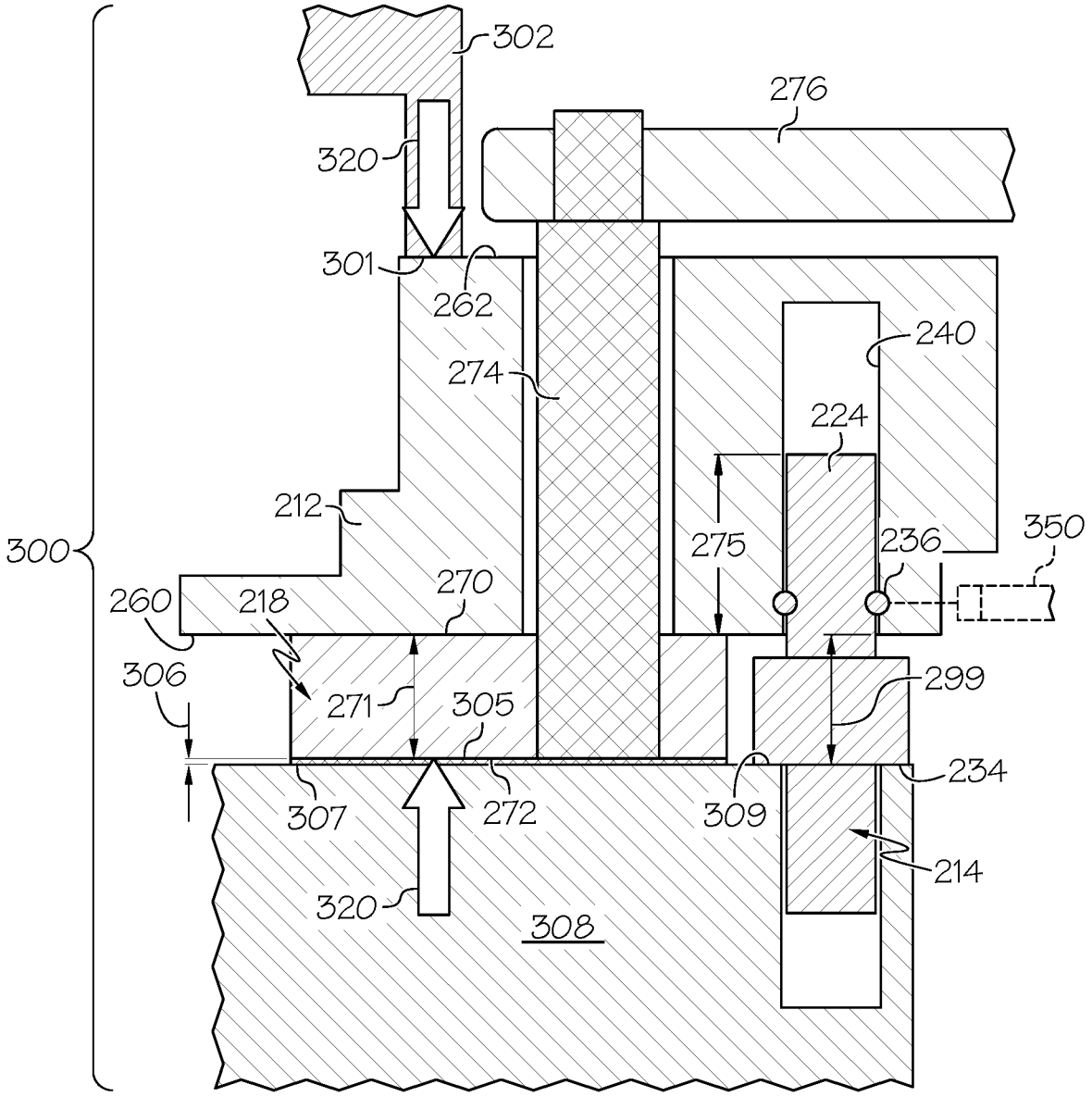

The first and second tool members 302, 304 may be supported for movement such that the first and second contact areas 301, 305 move linearly toward each other, parallel to the axes 103, 280, 277. As shown in FIG. 7, the tool 300 may be operated (manually or automatically) to move the first contact area 301 into abutting contact with the outer surface 262 of the first support structure 212, to move the second contact area 305 into abutting contact with the second side surface 272 of the vane 218, and to move the third contact area 309 into abutting contact with the control surface 234 of the spacer 214. This movement may also advance the spacer 214 into spacer aperture 240 and/or into the spacer aperture 311. Slight compressive pressure may be applied along the axis 103 as represented by arrows 320 to maintain abutting contact between the inner surface 260 and the first side surface 270, between the second side surface 272 and the second contact area 305, and between the control surface 234 and the third contact area 309. It will be appreciated that the shim 307 may be shaped so as to contact multiple (e.g., each) of the vanes 218 and to provide clearance from the spacers 214 and/or other components.

The thickness 306 of the shim 307 may be predetermined and selected such that, in the position shown in FIG. 7, the spacer 214 is positioned at the predetermined depth 275 within the spacer aperture 240, and the control surface 234 projects the predetermined distance 299 from the first inner surface 260. In some embodiments, the first part 224 of the spacer 214 may be fixedly attached to the first support structure 212 at this position due to a friction fit. In other words, the first part 224 is press-fit into the aperture 240 at the predetermined depth 275 due to the stroke of the tool 300. Alternatively or in addition, a welding tool 350 may be used to weld the spacer 214 to the first support member 212. In some embodiments, the welding tool 350 may be a laser welding tool. The welded attachments 236 may be provided at a predetermined locations. Accordingly, as represented in FIG. 7, the thickness 271 of the vane 218 controls the depth 275 at which the spacer 214 is attached and the distance 299 at which the control surface 234 is projected from the inner surface 260.

Figure 8:
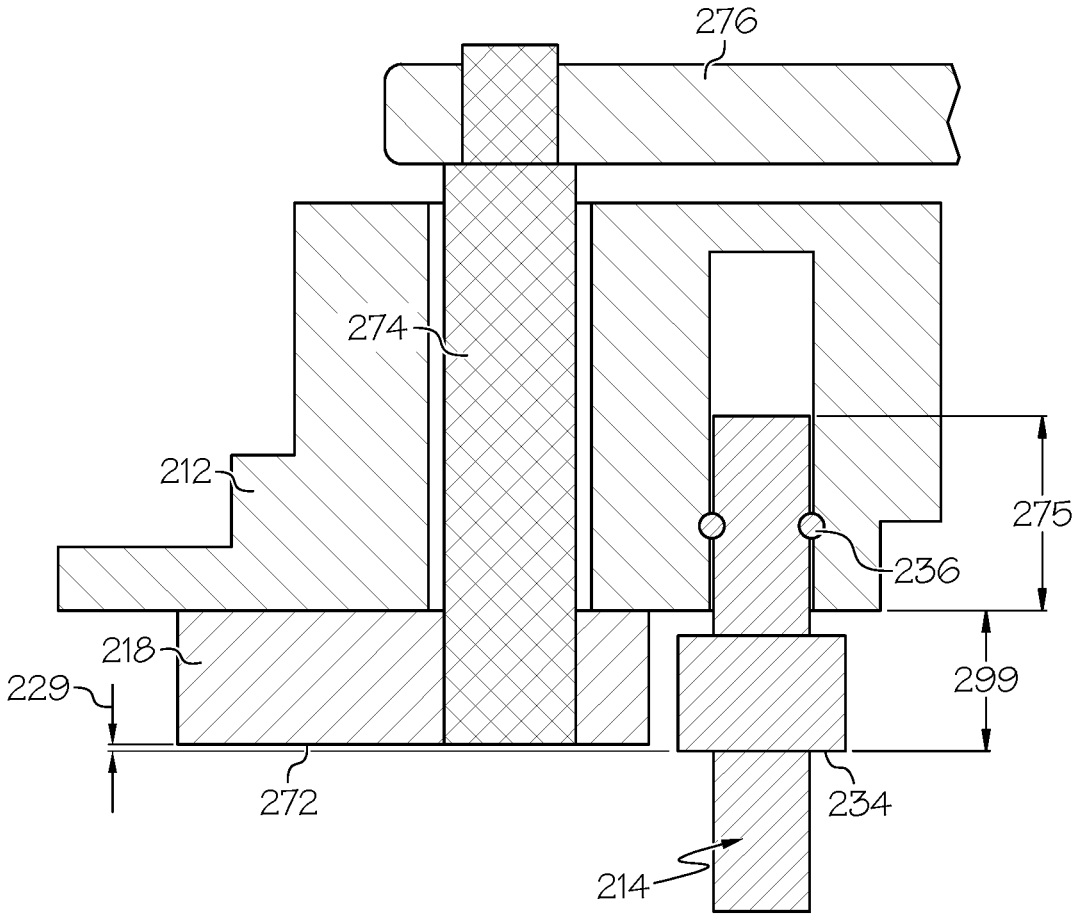

Subsequently, as shown in FIG. 8, the first support structure 212, the vanes 218, and the attached spacers 214 may be removed from the tool 300. The spacers 214 are fixedly attached at this point to the first support structure 212 at the predetermined depth 275 and/or projecting at the predetermined distance 299. At this juncture, the second side surface 272 is spaced away from the control surface 234 at a distance substantially equal to the clearance dimension 229.

Next, the second support structure 206 may be attached to the second part 226 of the spacer 214 as shown in FIG. 4. As mentioned above, the second part 226 may be inserted within the spacer aperture 242, and then the second part 226 may be riveted to the second support structure 206. In some embodiments, an orbital riveting tool 381 may be used for the riveting process. The tool 381 may be disposed at an angle 383 relative to the axis 277 of the spacer 214 and may reciprocate to deform the terminal end 282 and form the rivet head 241. At this point, the clearance dimension 229 may be set.

Figure 9:
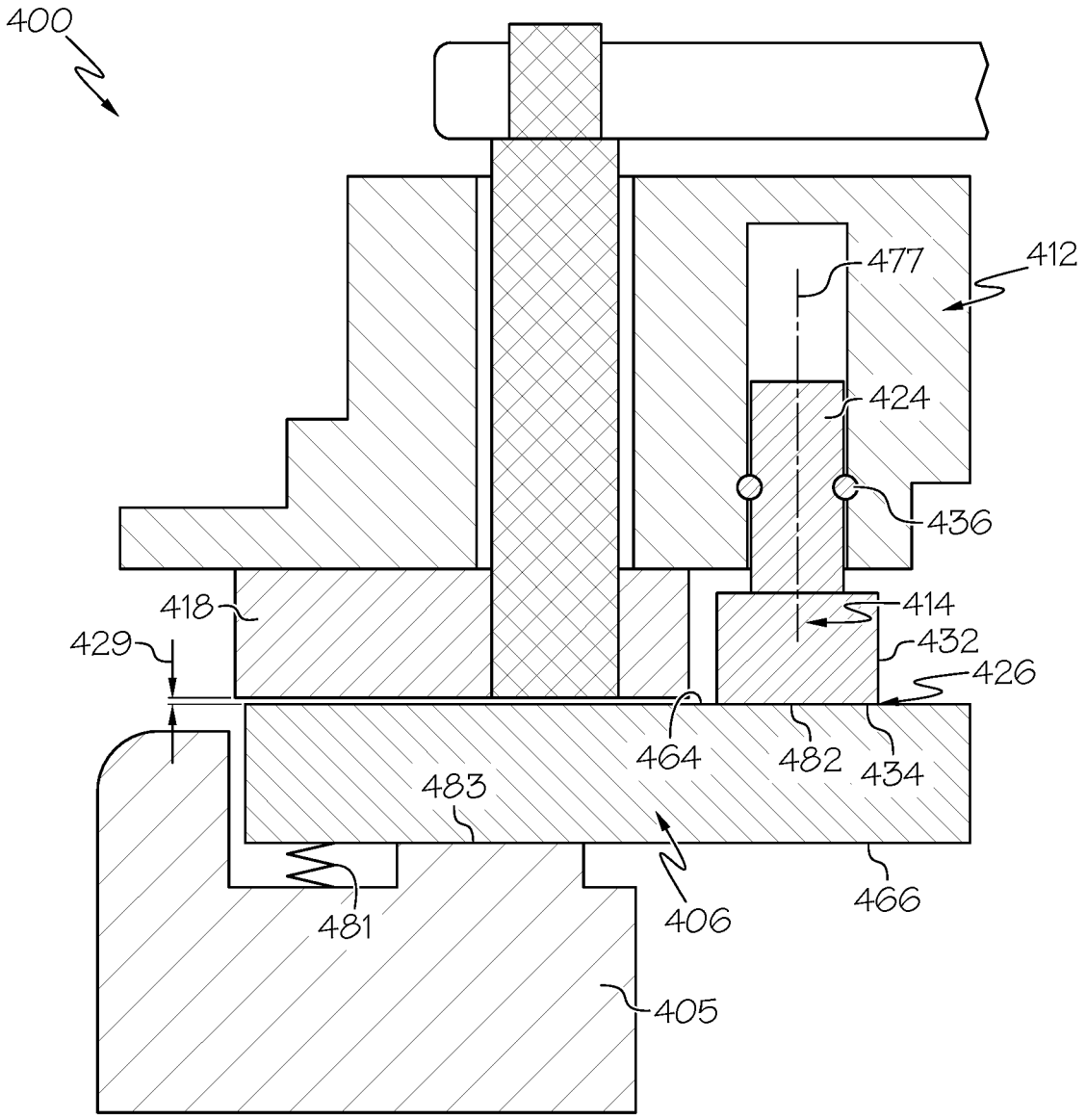
FIG. 9 is a schematic section view of the variable vane mechanism according to additional example embodiments of the present disclosure.

Referring now to FIG. 9, additional embodiments of the vane mechanism 400 will be discussed. Additional embodiments of the manufacturing method will be discussed according to FIGS. 10 and 11. There may be similar features to those of FIGS. 4-8 except as noted below. Components that correspond to those of FIGS. 4-8 will be referred to with corresponding reference numbers increased by 200.

As shown in FIG. 9, the spacers 414 may include a cylindrical first part 424 and the collar-like projection 432, similar to the embodiments discussed above. The first part 424 may be received partially within the first support structure 412. However, the second part 426 of the spacer 414 (the part that is supported on and supported by the second support structure 406) is different from the spacers 214 discussed above. In the illustrated embodiment, the second part 426 is defined by the control surface 434 of the projection 432, and the control surface 434 is defined on the terminal end 482 of the spacer 414. The control surface 434 abuts the inner surface 464 of the second support structure 406 similar to the above embodiments; however, the second part 426 remains outside of the second support structure 406 instead of being received within the second support structure 406.

Furthermore, the second support structure 406 may be disc-like with a substantially planar and continuous inner surface 464 and a substantially planar and continuous outer surface 466. As shown, the outer surface 466 may abut against an opposing surface 483 of the turbine housing 405. In some embodiments, there may be a biasing member 481 disposed between the turbine housing 405 and the second support structure 406. The biasing member 481 may bias the second support structure 406 toward the control surface 434 of the spacer 414. The biasing force provided by the biasing member 481 may be sufficient to maintain contact between the inner surface 464 and the control surface 434 when the vane mechanism 200 is subjected to normal operational loads.

Figure 10:
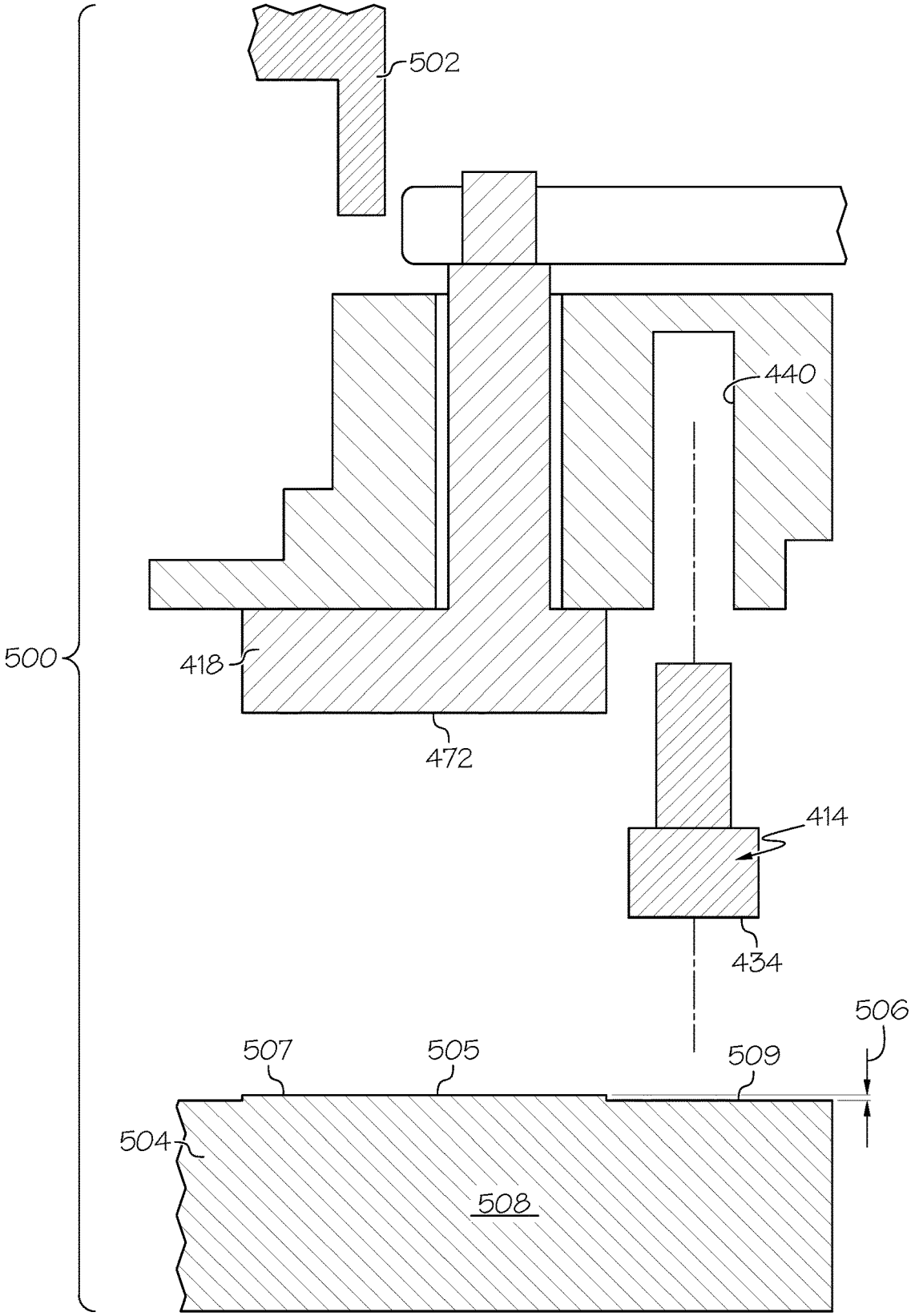
FIGS. 10-11 are schematic section views illustrating a method of manufacturing the variable vane mechanism of FIG. 9 according to additional example embodiments of the present disclosure.

As shown in FIG. 10, the first tool member 502 may be substantially similar to the above embodiments. However, the second tool member 504 may be different. The shim 507 may be integrally attached to the base 508 so as to be unitary. The shim 507 may project from the base 508 as indicated by 506 in FIG. 10.

Figure 11:
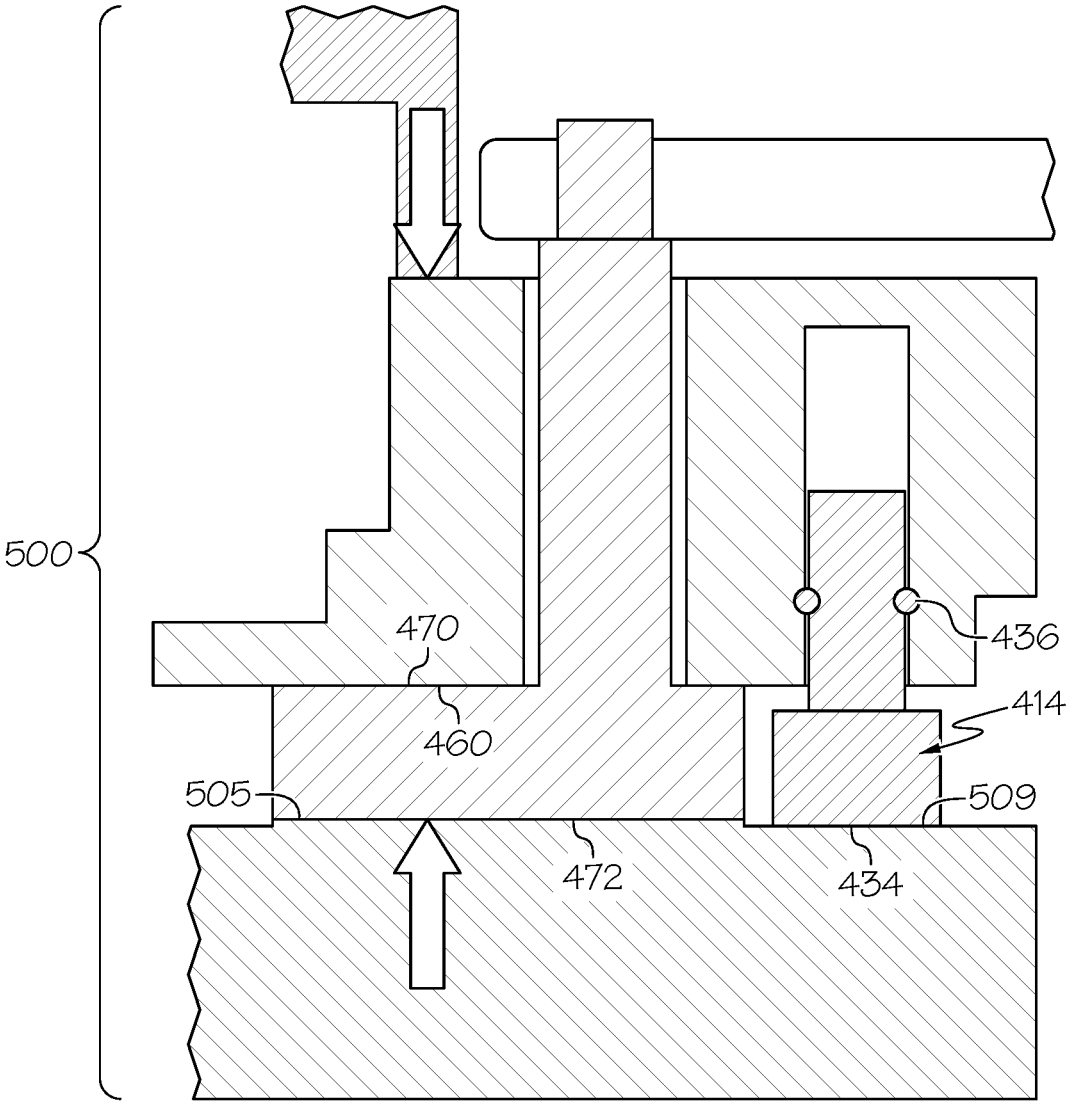

As shown in FIG. 11, the tool 500 may be actuated to bring the first side surface 470 into abutting contact with the inner surface 460, the second side surface 472 into abutting contact with the second contact area 505, and the control surface 434 into abutting contact with the third contact area 509. The spacer 414 may be fixed in this position by friction, by adding weldments, or by including other attachments 436.

Subsequently, as shown in FIG. 9, the second support structure 406 may be abutted against the control surface 434, thereby providing the predetermined vane clearance dimension 429. Finally, the variable vane mechanism 400 may be provided within the turbine housing 405 with the biasing member 481 biasing the second support structure 406 against the support surface 434 and maintaining the clearance dimension 429 as substantially constant.

Figure 12:
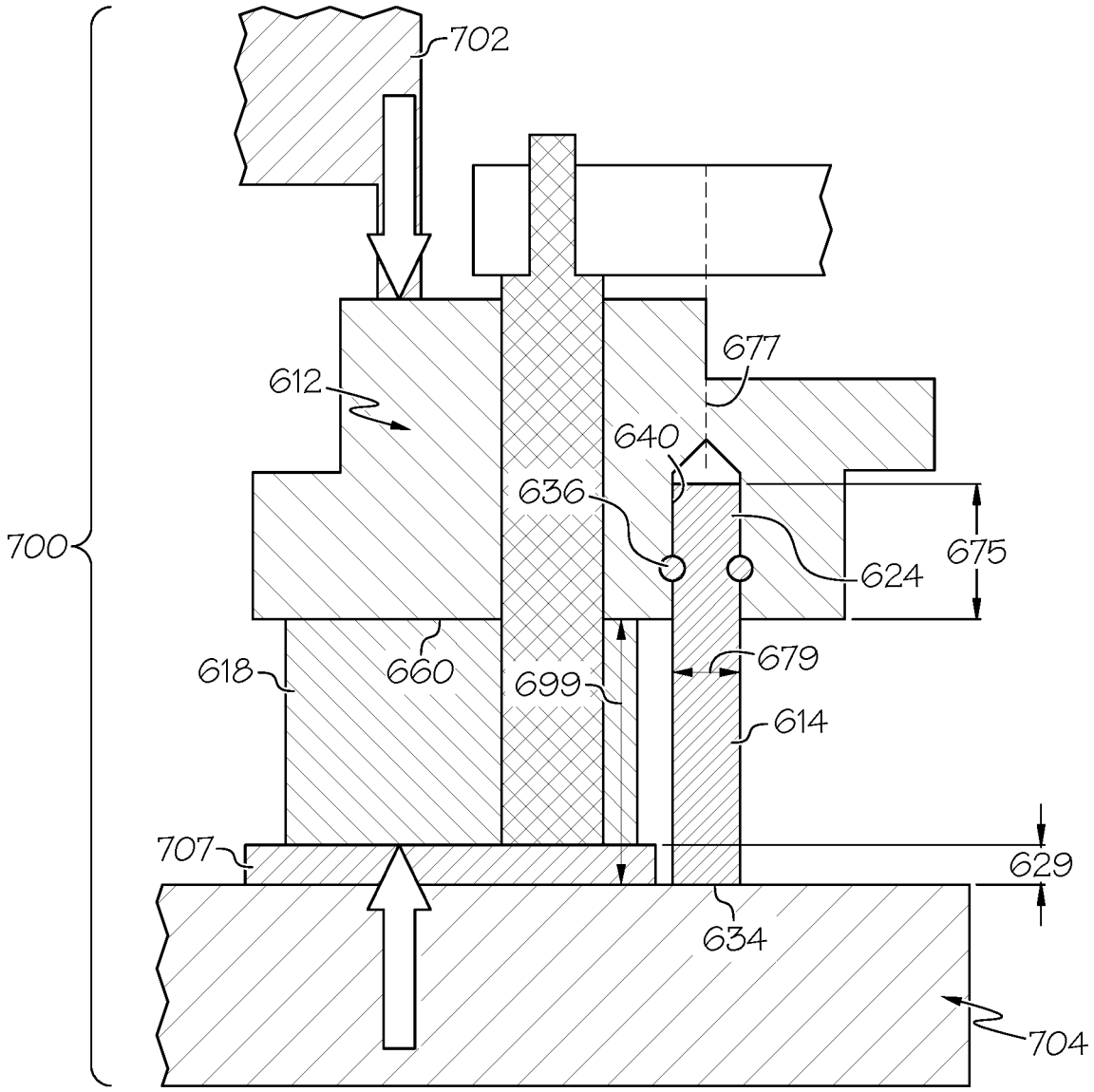
FIG. 12 is a schematic section view of the variable vane mechanism and a method of manufacturing the same according to additional example embodiments of the present disclosure.

Referring now to FIG. 12, additional embodiments present disclosure will be discussed. This embodiment may be substantially similar to the embodiment of FIGS. 9-11 except as noted. Components that correspond to those of FIGS. 9-11 will be identified with corresponding reference numbers increased by 200.

The spacers 614 may be substantially shaped as a right cylinder. Also, the spacer 614 may have a rounded (e.g., circular) cross section taken through the spacer axis 677. This cross section may remain substantially constant along the axis 677. A spacer width (e.g., diameter 679) may remain substantially constant along a majority of its length. This is in contrast to the embodiments of the spacers 214, 414, which vary in diameter along their lengths due to the collar-like projection 232, 432. It will be appreciated that the spacers 614 of FIG. 12 may be manufactured relatively simply and inexpensively. As such, the spacers 614 may reduce manufacturing costs overall.

As represented in FIG. 12, the tool 700 may be used to compress the first tool member 702 against the first support structure 612 and the shim 707 of the second tool member 704 against the vane 618, similar to the embodiments above. This action may consequently position the spacer 614 at a predetermined depth 675 within the spacer aperture 640. One or more fixed attachments 636 may be established between the spacer 614 and the first support structure 612. This attachment 636 may be a friction-fit established from pressing the first part 624 into the aperture 640. This attachment 636 may be a weldment formed from a laser welding process. The attachment 636 may be established to fix the control surface 634 at the predetermined distance 699 from the first inner surface 660.

Once the spacer 614 is attached to the first support structure 612, the second support structure may be supported on the spacer 614 similar to the embodiment of FIG. 9. The second support structure may abut against the control surface 634 such that the spacer 614 maintains the predetermined clearance dimension 629. A biasing member may be included similar to FIG. 9 to bias the second support structure against the control surface 634.

As mentioned above, the shim 707 may be removable and replaceable. In some embodiments of the present disclosure, at least two turbochargers may be designed: a first turbocharger and a second turbocharger. The methods the present disclosure may include predetermining a first vane clearance dimension for the first turbocharger and a different second vane clearance dimension for the second turbocharger. In some embodiments, a computer generated model may be used to determine the different vane clearance dimensions. In some embodiments, a first shim may be selected to form the vane mechanism for the first turbocharger, and a different second shim (or series of stacked shims) may be selected to form the vane mechanism for the second turbocharger. The thickness of the first shim may be determined according to the desired first vane clearance dimension for the first turbocharger. The thickness of the second shim may be determined according to the desired second vane clearance dimension for the second turbocharger. The vane mechanism for the first turbocharger may be manufactured with the selected first shim as discussed above to provide the first vane clearance dimensions. The vane mechanism for the second turbocharger may be manufactured with the selected second shim as discussed above to provide the second vane clearance dimensions.

Accordingly, the manufacturing techniques of the present disclosure may improve the operating performance of the turbocharger. The spacers 214, 414, 614 may maintain accurate and precise vane clearance dimensions, which thereby provides high operating efficiencies for the turbocharger 112. The methods of the present disclosure may increase manufacturing efficiency, accuracy, repeatability, and more.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the present disclosure in any way. Rather, the foregoing detailed description will provide those skilled in the art with a convenient road map for implementing an exemplary embodiment of the present disclosure. It is understood that various changes may be made in the function and arrangement of elements described in an exemplary embodiment without departing from the scope of the present disclosure as set forth in the appended claims.

What is claimed is:

1. A method of manufacturing a variable vane mechanism comprising:

arranging a vane and a spacer between a first support structure and a tooling surface;

abutting a first inner surface of the first support structure against a first side surface of the vane and a second side surface of the vane against the tooling surface, leaving a control surface of the spacer projecting from the first support structure at a predetermined distance;

fixedly attaching, while abutting the first inner surface against the first side surface and the second side surface against the tooling surface, the spacer to the first support structure with the control surface of the spacer projecting from the first support structure at the predetermined distance; and abutting, after fixedly attaching the spacer to the first support structure, a second support structure on the control surface of the spacer to define a gap between the first support structure and the second support structure, the vane disposed within the gap.

2. The method of claim 1, further comprising providing a shim having a predetermined thickness that corresponds to a predetermined vane clearance dimension, the vane clearance dimension being measured between the vane and at least one of the first and second support structures.

3. The method of claim 1, wherein the spacer extends partially through the first support structure while abutting the first inner surface against the first side surface and the second side surface against the tooling surface.

4. The method of claim 3, wherein fixedly attaching the spacer includes frictionally fixing the spacer to the first support structure.

5. The method of claim 3, wherein fixedly attaching the spacer includes welding the spacer to the first support structure.

6. The method of claim 1, further comprising fixedly attaching the spacer to the second support structure.

7. The method of claim 6, wherein fixedly attaching the spacer to the second support structure includes riveting the spacer to the second support structure.

8. The method of claim 1, wherein the first support structure includes an aperture;

further comprising compressing the tooling surface toward the first support structure to provide the spacer at a predetermined depth within the aperture; and wherein fixedly attaching the spacer to the first support structure includes fixedly attaching the spacer to the first support structure at the predetermined depth within the aperture.

9. A method of manufacturing a variable vane mechanism comprising:

selecting a thickness of a shim according to a predetermined vane clearance dimension for the variable vane mechanism;

arranging a vane between a first support structure and the selected shim, and arranging a spacer between the first support structure and a base surface;

abutting a first inner surface of the first support structure against a first side surface of the vane, a second side surface of the vane against the shim, and a control surface of the spacer against the base surface, leaving the control surface of the spacer projecting from the first support structure at a predetermined distance;

fixedly attaching, while abutting the first inner surface against the first side surface and the second side surface against the shim, the spacer to the first support structure with the control surface of the spacer projecting from the first support structure at the predetermined distance; and abutting, after fixedly attaching the spacer to the first support structure, a second support structure on the control surface of the spacer to define a gap between the first support structure and the second support structure, the vane disposed within the gap with the predetermined vane clearance dimension.

* * * * *